US006553687B1

(12) United States Patent
Leamon, Jr.

(10) Patent No.: US 6,553,687 B1
(45) Date of Patent: Apr. 29, 2003

(54) HELMET DRYER

(76) Inventor: J. Wayne Leamon, Jr., 1159 Holloway Church Rd., Lexington, NC (US) 27292

( * ) Notice: Subject to any disclaimer, the term of this patent is extended or adjusted under 35 U.S.C. 154(b) by 0 days.

(21) Appl. No.: 09/953,634

(22) Filed: Sep. 17, 2001

(51) Int. Cl.[7] ..... F26B 25/00
(52) U.S. Cl. ..... 34/104; 34/103; 34/90
(58) Field of Search ..... 34/90, 103–106

(56) References Cited

U.S. PATENT DOCUMENTS

| | | | | | |
|---|---|---|---|---|---|
| 4,085,519 | A | * | 4/1978 | Masika | 34/104 |
| 4,136,464 | A | * | 1/1979 | Hay | 34/104 |
| 4,253,630 | A | | 3/1981 | Rigg | |
| 4,434,514 | A | | 3/1984 | Sundahl et al. | |
| 5,058,289 | A | * | 10/1991 | Guindon | 34/104 |
| 5,115,580 | A | | 5/1992 | Blumenfeld et al. | |
| 5,245,994 | A | | 9/1993 | Chang et al. | |
| 5,287,636 | A | * | 2/1994 | Lafleur et al. | 34/104 |
| 5,377,849 | A | | 1/1995 | Martin | |
| 5,412,928 | A | * | 5/1995 | Reithel | 34/104 |
| 5,514,346 | A | * | 5/1996 | Fujita | 422/124 |
| 5,592,750 | A | * | 1/1997 | Eichten | 34/104 |
| 6,216,359 | B1 | * | 4/2001 | Peet | 34/105 |
| 6,327,792 | B1 | * | 12/2001 | Hebert | 34/104 |

* cited by examiner

*Primary Examiner*—Ira S. Lazarus
*Assistant Examiner*—Andrea M. Ragonese

(57) ABSTRACT

The helmet dryer described includes an electric fan mounted in a base having a stanchion for supporting a helmet. The dryer provides convenience in removing moisture from a helmet worn during strenuous activities. The electric fan delivers air through perforations in the stanchion which circulates along the inside of the helmet for drying purposes. The helmet is separated from the stanchion by spacers affixed to a dome to insure a proper, complete air flow along the inside of the helmet.

15 Claims, 3 Drawing Sheets

HELMET DRYER

FIELD OF THE INVENTION

The invention herein pertains to drying articles which have been worn and particularly pertain to drying helmets used when racing vehicles such as automobiles.

DESCRIPTION OF THE PRIOR ART AND OBJECTIVES OF THE INVENTION

Paper towels, hand-held blowers and other items have been used to wipe and dry the inside of helmets which are wet with perspiration after use by race car drivers. However, such "hand" drying removes only surface moisture and does not necessarily reach all the crevices and areas containing moisture along the inside of the helmet. Hence, when the driver uses the helmet again, such as for a second race on that day, he is confronted with a damp, uncomfortable helmet which can be distracting to his concentration.

Thus, with the difficulties, inconvenience and incompleteness associated with drying the inside of a helmet by hand, whether using a towel or electric blower, the present invention was conceived and one of its objectives is to provide a simple, quick and effective means for drying a helmet such as worn by race car drivers.

It is still another objective of the present invention to provide a stanchion for drying helmets which allows removal of all moisture as contained therein.

It is yet another objective of the present invention to provide a helmet dryer which can be connected to a conventional 110 volt A.C. source and operated with the helmet placed thereon.

It is another objective of the present invention to provide an air filtering cartridge as featured in an alternate embodiment.

It is a further objective of the present invention to provide a helmet drying device which has spacers for separating the helmet from the device to insure a proper and effective air flow.

It is yet another objective of the present invention to provide a helmet dryer which allows "hands free" drying and which is relatively inexpensive to manufacture and distribute.

Various other objectives and advantages of the present invention will become apparent to those skilled in the art as a more detailed description is set forth below.

SUMMARY OF THE INVENTION

The aforesaid and other objectives are realized by providing a helmet dryer having a cylindrically shaped base containing an electric fan. Attached to the base and in fluid communication therewith is a stanchion containing a series of apertures and having a dome mounted at the top. The dome also provides apertures for air flow and includes a plurality of spacers on which the helmet is placed and which separates the inside of the helmet from the stanchion while the helmet is drying. The spacers permit air to freely move between the dome and the helmet to insure fast and efficient drying. By placing the helmet on the stanchion and turning on a switch, the electric fan blows air into the stanchion where it circulates through the helmet to dry all the moisture contained on the inside of the helmet. Within a few minutes the helmet is dried and can be removed for comfortable wearing during racing or other activities.

In an alternate embodiment of the invention a filter cartridge containing charcoal particles is utilized. The charcoal cartridge is positioned in the air stream of the stanchion to filter and remove odors from the air as it is directed into the helmet.

DETAILED DESCRIPTION OF THE PREFERRED EMBODIMENT AND OPERATION OF THE INVENTION

Figure 1:
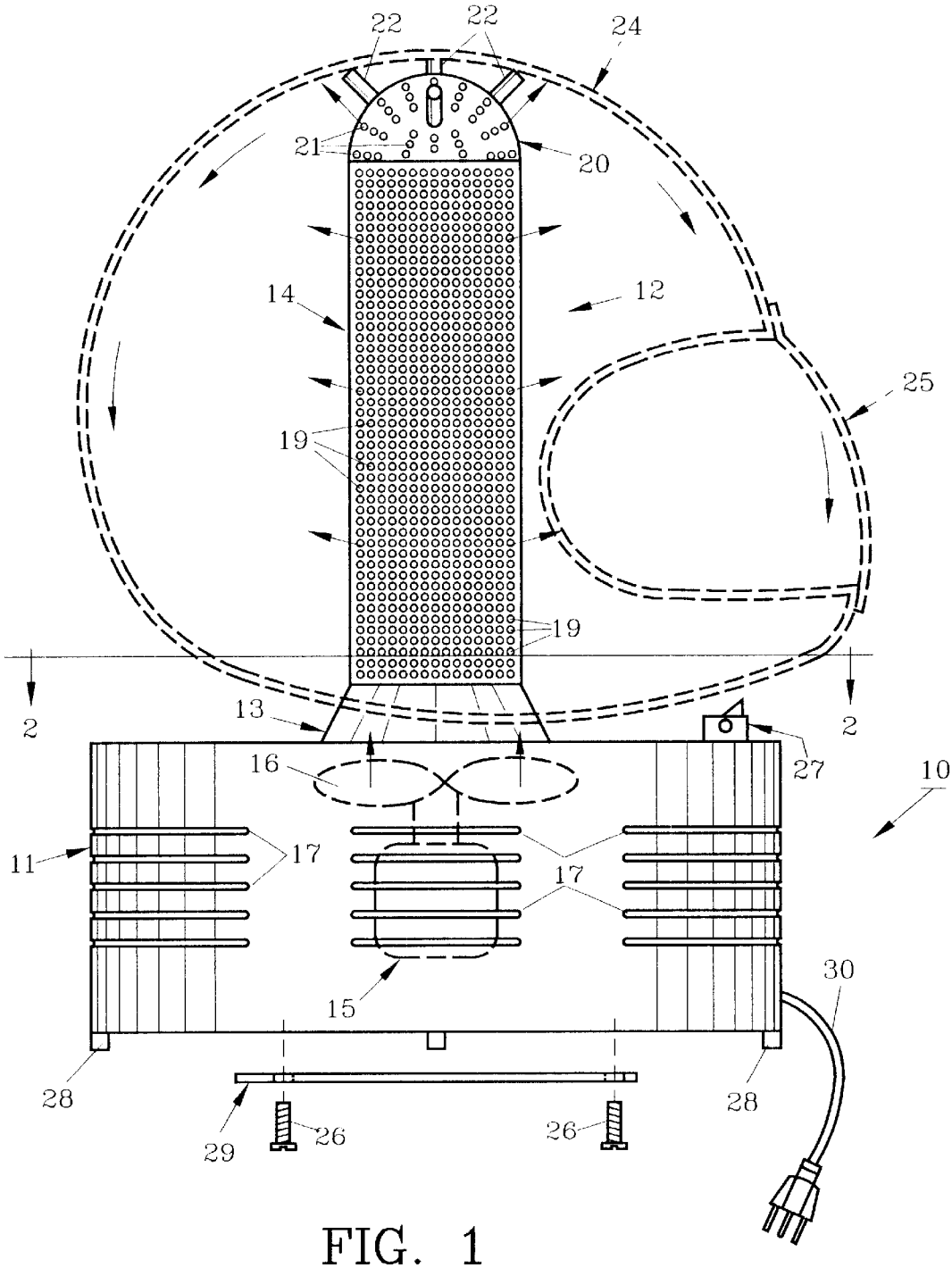
FIG. 1 is a side elevational view of the preferred helmet dryer of the invention with a helmet seen in ghost fashion thereon.
Figure 2:
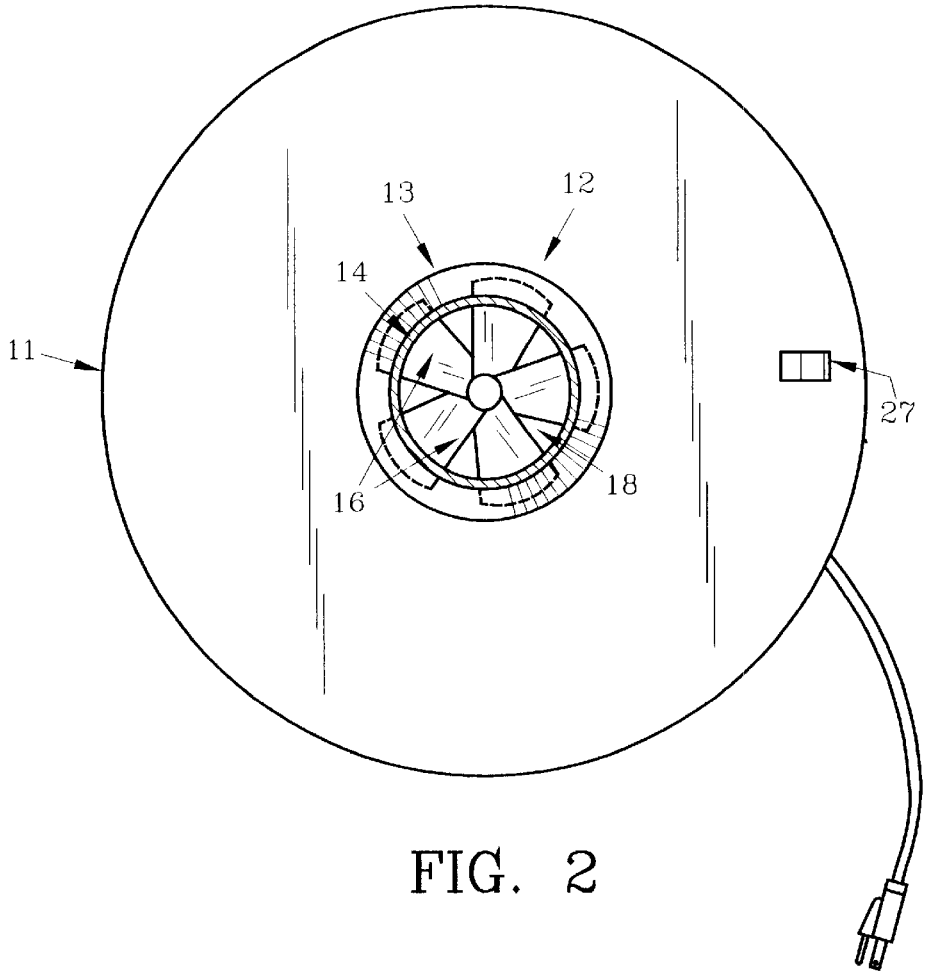
FIG. 2 is a top view of the device as seen in FIG. 1 along lines 2—2.

For a better understanding of the invention and its operation, turning now to the drawings, preferred helmet dryer 10 is shown in FIG. 1 having a base 11 which is cylindrically shaped (see also FIG. 2). Mounted atop base 11 is stanchion 12 which includes a relatively short inverted conical first section 13 joined to cylindrically shaped upper second section 14. Base 11, first section 13 and second section 14 are preferably formed from 0.080 inch aluminum sheeting and are fastened together preferably by rivets, although screws, weldments or the like can be used. Stanchion 13 is thus in fluid communication with base 11 via opening 18 (FIG. 2) and allows electric fan 15 having preferably five blades 16 to draw air through vents 17 and direct it upwardly through opening 18 in base 11, through stanchion first section 13, stanchion second section 14 and into dome 20. The directed air in second section 14 exits through apertures 19 therein to dry helmet 24. Directed air also is forced through apertures 21 of dome 20 positioned atop stanchion 12. Dome 20, like stanchion 12 is preferably formed of 0.080 aluminum sheeting. Base 11 is approximately five inches tall (12.7 cm) and twelve inches wide (30.48 cm) whereas first section 13 has a four inch (10.16 cm) diameter at its base 11 and has a three inch (7.62 cm) diameter at its upper distal end. First section 13 has a height of preferably, approximately one inch (2.54 cm). Second section 14 has a height of approximately nine inches (22.86 cm)and has a diameter of approximately three inches (7.62 cm) for attachment to first section 13.

Should it become necessary to remove or repair electrical motor 15, round, planar door 29 covers an opening (not seen) in the bottom of base 11 and is sized to allow motor 15 with blades 16 to pass therethrough after removal of bolts 26.

Closed spacers 22 are affixed to dome 20 with rivets, screws or the like and are preferably, cylindrically shaped and A have a height of approximately one inch (2.54 cm). Spacers 22 positioned on dome 22 permit typical helmet 24 as used in automobile racing, to rest thereon in a stable fashion with face shield 25 closed. Four such spacers are preferred, depending on the exact positioning and size of spacer selected.

Figure 3:
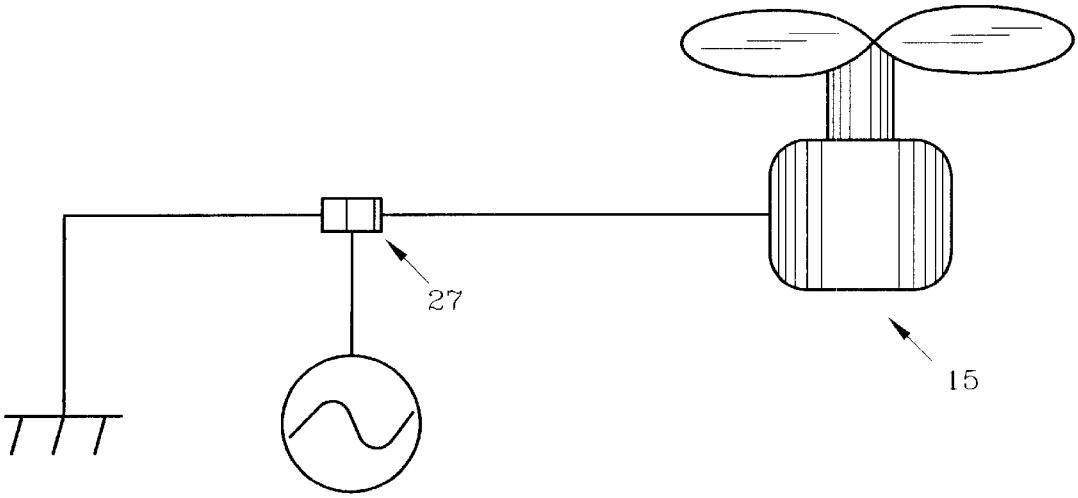
FIG. 3 is a schematic diagram of the electric circuit.

In operation, helmet dryer 10 is placed on a floor, table or other convenient location on four legs 28 (only three seen) and electrical supply cord 30 is then connected to a 110 volt AC outlet. Switch 27 which is joined to electrical supply cord 30 is activated to operate fan 15 which has preferably a standard, fractional horsepower AC motor as shown schematically in FIG. 3. Fan blades 16 draw air through vents 17 in base 11 whereby said air is forced upwardly into stanchion 12 where it exits apertures 19 and 21 to dry the inside of helmet 24 in a fast, even and sufficient manner.

During activity such as vehicle racing, race car drivers perspire profusely thus causing the inside helmet padding, webbing, lining and the like to become extremely damp with moisture. After such activity ceases, the helmet can be easily removed, placed on helmet dryer 10 as shown in FIG. 1 and quickly dried and be ready for the next race. Car racing is but one of many sports that require helmets for safety and the present invention could be easily used for all such other activities.

Figure 5:
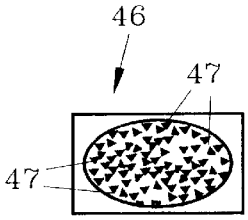
FIG. 5 shows a top view of the filter cartridge as removed from the helmet dryer.
Figure 4:
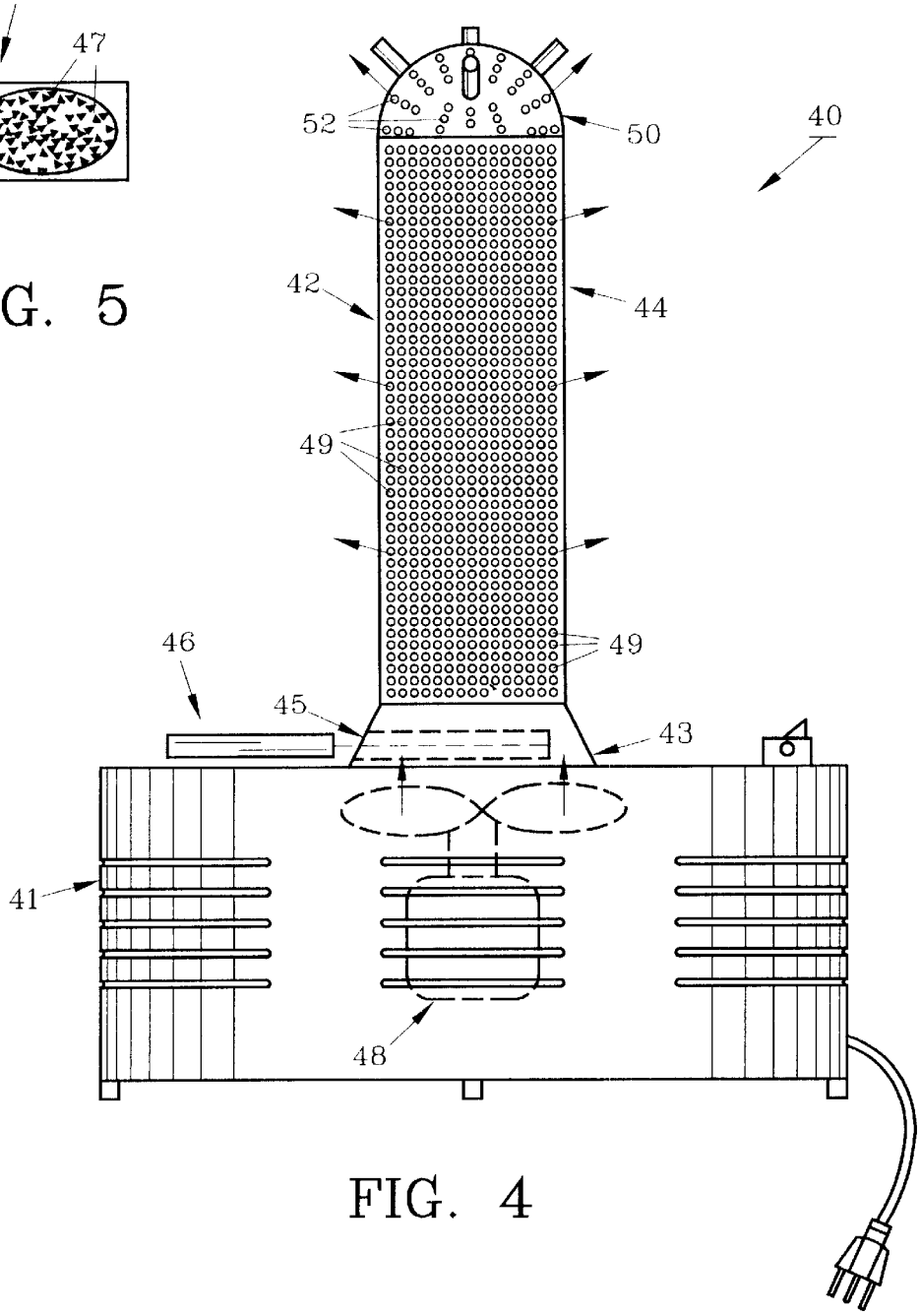
FIG. 4 is a side elevational view of an alternate form of the invention with a filter cartridge.

While preferred helmet dryer 10 is explained above respectively in FIGS. 1–3, an alternate embodiment is shown in FIG. 4. Here, helmet dryer 40 includes base 41, stanchion 42 having first conical section 43 and perforated second section 44 attached to perforated dome 50. Alternate helmet dryer 40 operates the same way as hereinbefore described for preferred helmet dryer 10, however, stanchion first section 43 includes a slot 45 for insertion of charcoal filter cartridge 46 (as also shown in FIG. 5). Cartridge 46 includes charcoal granules 47 which are conventionally used in air filters and the like for removing impurities and odors from air passing therethrough. Fan 48 will thus direct air through cartridge 46 before it passes upwardly into stanchion second section 44 and exits apertures 49 and apertures 52 in dome 50. In use, odor masking agents and the like can also be used in cartridge 46 in place of or in conjunction with charcoal particles 47 as shown in FIG. 5. Cartridge 46 can thus remove odors and provide a pleasant scent to the air which dries helmets such as helmet 24 seen in FIG. 1.

The illustrations and examples provided herein are for explanatory purposes and are not intended to limit the scope of the appended claims.

I claim:

1. A dryer for a helmet comprising: a base, a stanchion, said stanchion mounted on said base, a dome, said dome positioned on top of said stanchion, said dome defining a plurality of apertures, a series of closed spacers, said spacers mounted around said dome to allow the helmet to rest thereon in a stable fashion while separated from said dome, whereby air is drawn through said base and directed through said stanchion and dome for drying the helmet positioned thereon.

2. The dryer of claim 1 wherein said base is cylindrically shaped.

3. The dryer of claim 1 further comprising a fan, said fan contained within said base.

4. The dryer of claim 1 wherein said stanchion comprises a first section, a second section, said first section joined to said second section, said first section mounted on said base.

5. The dryer of claim 4 wherein said stanchion second section defines a plurality of apertures.

6. The dryer of claim 4 wherein said stanchion first section is conically shaped.

7. The dryer of claim 1 wherein said base defines an air entry slot.

8. The dryer of claim 4 further comprising an air filter, said air filter positioned in said stanchion first section.

9. The dryer of claim 8 wherein said air filter contains absorbent carbon.

10. The dryer of claim 3 further comprising a switch, said switch connected to said fan for activating said fan.

11. The dryer of claim 1 further comprising a door, said door attached to said base.

12. A dryer for a helmet comprising:

a cylindrical base, a stanchion, said stanchion in communication with said base, said stanchion comprising a first section, said first section attached to said base, a second section, said second section defining a plurality of apertures, said second section attached to said first section, a dome, said dome defining a plurality of apertures, said dome affixed to said second section, a plurality of closed spacers, said spacers affixed to said dome, said spacers for separating the helmet from the dome to allow air to flow to said helmet from said dome, a fan, said fan mounted on said base, whereby said fan will direct air from said base through said stanchion to exit said apertures.

13. The dryer of claim 12 further comprising a filter cartridge, said filter cartridge mounted in said first section.

14. The dryer of claim 12 wherein said first section is conically shaped.

15. The dryer of claim 12 wherein said plurality of spacers are affixed to said dome to allow the helmet to rest in a stable manner thereon.

* * * * *